US010290443B2

(12) United States Patent
Fujita et al.

(10) Patent No.: US 10,290,443 B2
(45) Date of Patent: May 14, 2019

(54) SWITCH

(71) Applicant: OMRON Corporation, Kyoto-shi, Kyoto (JP)

(72) Inventors: Hiroyuki Fujita, Okayama (JP); Kenji Kuroki, Okayama (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/933,987

(22) Filed: Mar. 23, 2018

(65) Prior Publication Data

US 2018/0315558 A1 Nov. 1, 2018

(30) Foreign Application Priority Data

Apr. 28, 2017 (JP) ..... 2017-090160

(51) Int. Cl.

| | |
|---|---|
| ***H01H 13/10*** | (2006.01) |
| ***H01H 13/20*** | (2006.01) |
| ***H01H 13/52*** | (2006.01) |
| ***H01H 13/18*** | (2006.01) |
| ***H01H 13/28*** | (2006.01) |

(52) U.S. Cl.

CPC ..... *H01H 13/20* (2013.01); *H01H 13/10* (2013.01); *H01H 13/18* (2013.01); *H01H 13/28* (2013.01); *H01H 13/52* (2013.01)

(58) Field of Classification Search

CPC ..... H01H 13/20; H01H 13/10; H01H 13/18; H01H 13/28

See application file for complete search history.

(56) References Cited

U.S. PATENT DOCUMENTS

| | | | | |
|---|---|---|---|---|
| 5,670,761 | A | 9/1997 | Rya et al. | |
| 8,921,724 | B2 * | 12/2014 | Young | H01H 13/60 200/345 |
| 9,099,263 | B2 * | 8/2015 | Orrico | H01H 5/30 |
| 2008/0029376 | A1 * | 2/2008 | Ngoagouni | H01H 13/20 200/345 |
| 2008/0029378 | A1 * | 2/2008 | Kahnert | H01H 13/14 200/541 |
| 2012/0152713 | A1 | 6/2012 | Orricio | |
| 2012/0312673 | A1 | 12/2012 | Young | |

(Continued)

FOREIGN PATENT DOCUMENTS

| | | | |
|---|---|---|---|
| CN | 102484009 | A | 5/2012 |
| CN | 202405151 | U | 8/2012 |

(Continued)

*Primary Examiner* — Kyung S Lee

(74) *Attorney, Agent, or Firm* — Metrolexis Law Group, PLLC

(57) ABSTRACT

A switch includes a housing, a common stationary contact terminal, an individual stationary contact terminal, and a plunger including a moving contact unit. The moving contact unit includes a body, a first arm, a second arm, and a third arm extending from the body in a direction intersecting with a parallel direction in which the common stationary contact terminal and the individual stationary contact terminal are arranged parallel to each other, electrically interconnected with each other, and are spaced apart from one another in the parallel direction, a first moving contact included in the first arm, a second moving contact included in the second arm, and a third moving contact included in the third arm.

12 Claims, 9 Drawing Sheets

(56) References Cited

U.S. PATENT DOCUMENTS

| | | | | |
|---|---|---|---|---|
| 2013/0199909 | A1* | 8/2013 | Young | H01H 13/14<br>200/345 |
| 2013/0273788 | A1* | 10/2013 | Fujita | H01R 13/04<br>439/884 |

FOREIGN PATENT DOCUMENTS

| | | | |
|---|---|---|---|
| CN | 103311002 | A | 9/2013 |
| EP | 1884970 | A2 | 2/2008 |
| JP | 4295599 | B2 | 7/2009 |
| WO | 2013039466 | A1 | 3/2013 |

* cited by examiner

SWITCH

CROSS REFERENCE TO RELATED APPLICATIONS

This application claims priority from prior Japanese Patent Application No. 2017-090160 filed with the Japan Patent Office on Apr. 28, 2017, the entire contents of which are incorporated herein by reference.

FIELD

The disclosure relates to a switch.

BACKGROUND

Patent Literature 1 describes a switch including a housing, which has a compartment, a common stationary contact and an individual stationary contact, which are arranged on the inner bottom of the compartment in a manner electrically independent of each other, a drive, which is removably inserted in the compartment, and a moving contact, which comes in slide contact with the common stationary contact and the individual stationary contact as the drive is inserted into and removed from the compartment.

The moving contact of the switch includes a second contact and a third contact, which are independent of each other and hold and come in slide contact with the individual stationary contact. The individual stationary contact includes a first contact point for arc erosion, which comes in contact with the second contact of the moving contact, and a second contact point, which comes in contact with the third contact of the moving contact later than the second contact. This structure prevents the individual stationary contact from being damaged by an arc that occurs when the individual stationary contact comes in contact with or separates from the moving contact.

CITATION LIST

Patent Literature

Patent Literature 1: Japanese Patent No. 4295599

SUMMARY

Technical Problem

The above switch has its contacts interconnected using arms extending in a direction in which the moving contact slides. The switch with larger capacity can have an arc that may damage the arms in a wide range in their longitudinal direction, thus disabling these contacts from functioning.

In response to this, one or more aspects are directed to a switch that can have larger capacity and include a moving contact unit less susceptible to damage from an arc.

Solution to Problem

A switch according to one or more aspects includes a housing, a common stationary contact terminal, an individual stationary contact terminal, and a plunger. The housing includes an internal compartment. The common stationary contact terminal extends from outside the housing to the compartment and is fixed to the housing, and includes a common stationary contact arranged in the compartment. The individual stationary contact terminal extends from outside the housing to the compartment and is arranged parallel to the common stationary contact terminal, and includes a first individual stationary contact and a second individual stationary contact that are fixed to the housing and arranged in the compartment and electrically independent of the common stationary contact terminal. The plunger is supported by the housing in a manner movable in a parallel direction in which the common stationary contact terminal and the individual stationary contact terminal are arranged parallel to each other. The plunger includes a moving contact unit arranged in the compartment in a manner to come in contact with, at one time, the common stationary contact, the first individual stationary contact, and the second individual stationary contact as the plunger moves in the parallel direction. The moving contact unit includes a body extending in the parallel direction, a first arm, a second arm, and a third arm extending from the body in a direction intersecting with the parallel direction and electrically interconnected and spaced from one another in the parallel direction, a first moving contact included in the first arm to come in contact with the common stationary contact, a second moving contact included in the second arm to come in contact with the first individual stationary contact, and a third moving contact included in the third arm to come in contact with the second individual stationary contact. The common stationary contact terminal, the individual stationary contact terminal, and the moving contact unit are configured to cause the second moving contact to separate from the first individual stationary contact and then the third moving contact to separate from the second individual stationary contact when the plunger moves in the parallel direction while the first moving contact is in contact with the common stationary contact, the second moving contact is in contact with the first individual stationary contact, and the third moving contact is in contact with the second individual stationary contact.

Advantageous Effects

The switch according to one or more aspects includes the moving contact unit with the first arm, the second arm, and the third arm each extending in the direction intersecting with the movement direction of the plunger. The arms of the moving contact unit are less susceptible to an arc that may occur when each moving contact comes in contact with or separates from the corresponding stationary contact as the plunger moves. The switch can also have higher capacity.

DETAILED DESCRIPTION

Embodiments will now be described with reference to the accompanying drawings. The terms indicating specific directions or positions (e.g., up, down, right, left, end, side) used herein as appropriate are for easy understanding of the invention with reference to the drawings, and do not limit the technical scope of the present invention. The embodiments described below are mere examples and do not limit the scope of the present invention and its applications or use. The drawings are schematic and are not drawn to scale but show only relative dimensions.

Figure 1:
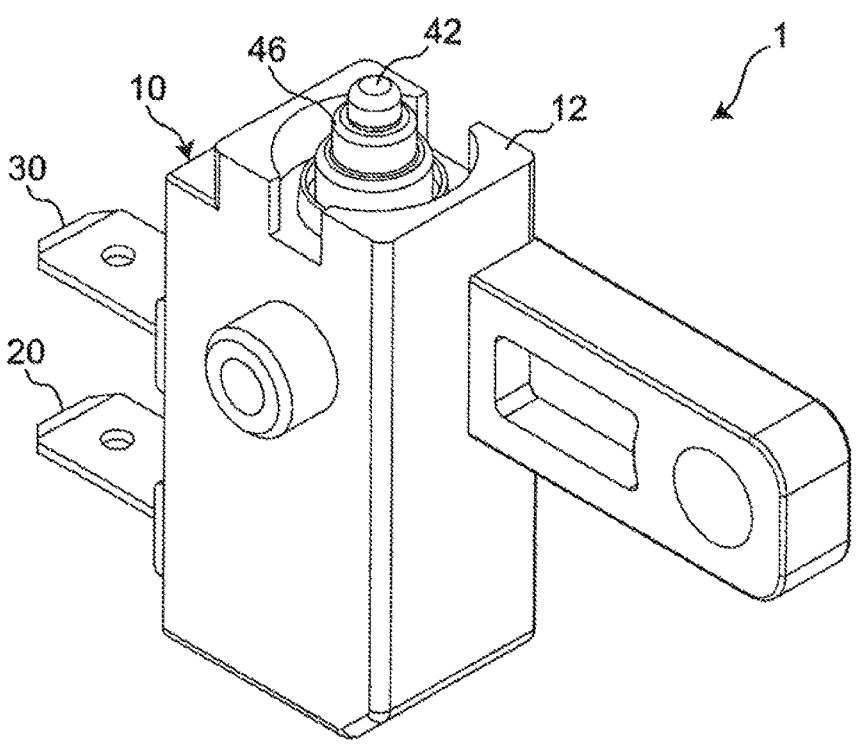
FIG. 1 is a perspective view illustrating a switch according to one or more embodiments.
Figure 2:
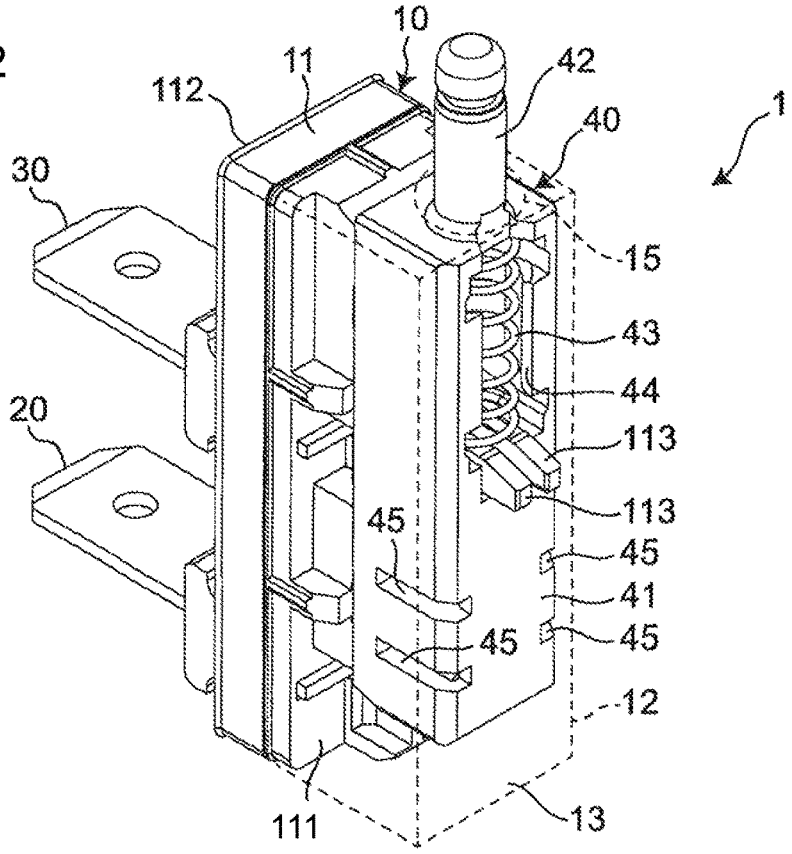
FIG. 2 is a perspective view illustrating a switch, such as in FIG. 1, with its cover removed.

As shown in FIGS. 1 and 2, a switch 1 according to one or more embodiments includes an insulating housing 10, which has an internal compartment 13, a conductive common stationary contact terminal 20 and a conductive individual stationary contact terminal 30, which are fixed to the housing 10, and a plunger 40, which is housed in the compartment 13.

The housing 10 includes a substantially rectangular base 11, and a substantially rectangular cover 12 covering one of the outer surfaces of the base 11.

As shown in FIG. 2, the base 11 includes a first rectangular surface 111, which defines the compartment 13 together with the cover 12, and a second rectangular surface 112 opposite to the first rectangular surface 111. The base 11 includes two terminal slots 14 (shown in FIG. 4), which extend through the first rectangular surface 111 and the second rectangular surface 112.

Figure 4:
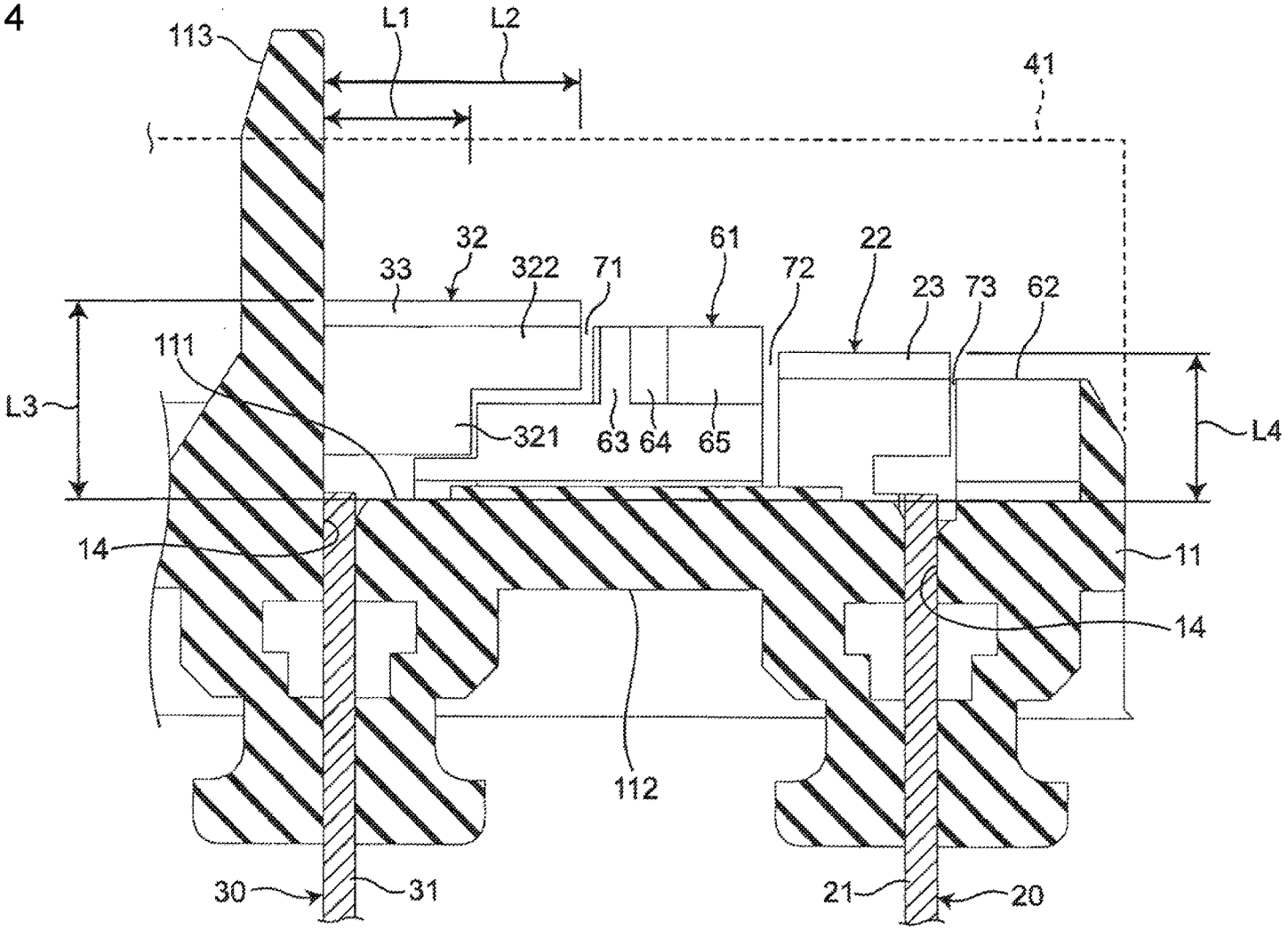
FIG. 4 is a diagram illustrating a cross-sectional view taken along line IV-IV in FIG. 3.

As shown in FIG. 4, the terminal slots 14 are spaced from each other in the longitudinal direction of the base 11. Each terminal slot 14 has a width in the lateral direction of the base 11 (in a direction orthogonal to the sheet of FIG. 4). Each terminal slot 14 receives and holds the common stationary contact terminal 20 or the individual stationary contact terminal 30. In other words, the common stationary contact terminal 20 and the individual stationary contact terminal 30 are arranged parallel to each other in the thickness direction of the base 11, and are fixed to the housing 10 in a manner electrically independent of each other.

Figure 3:
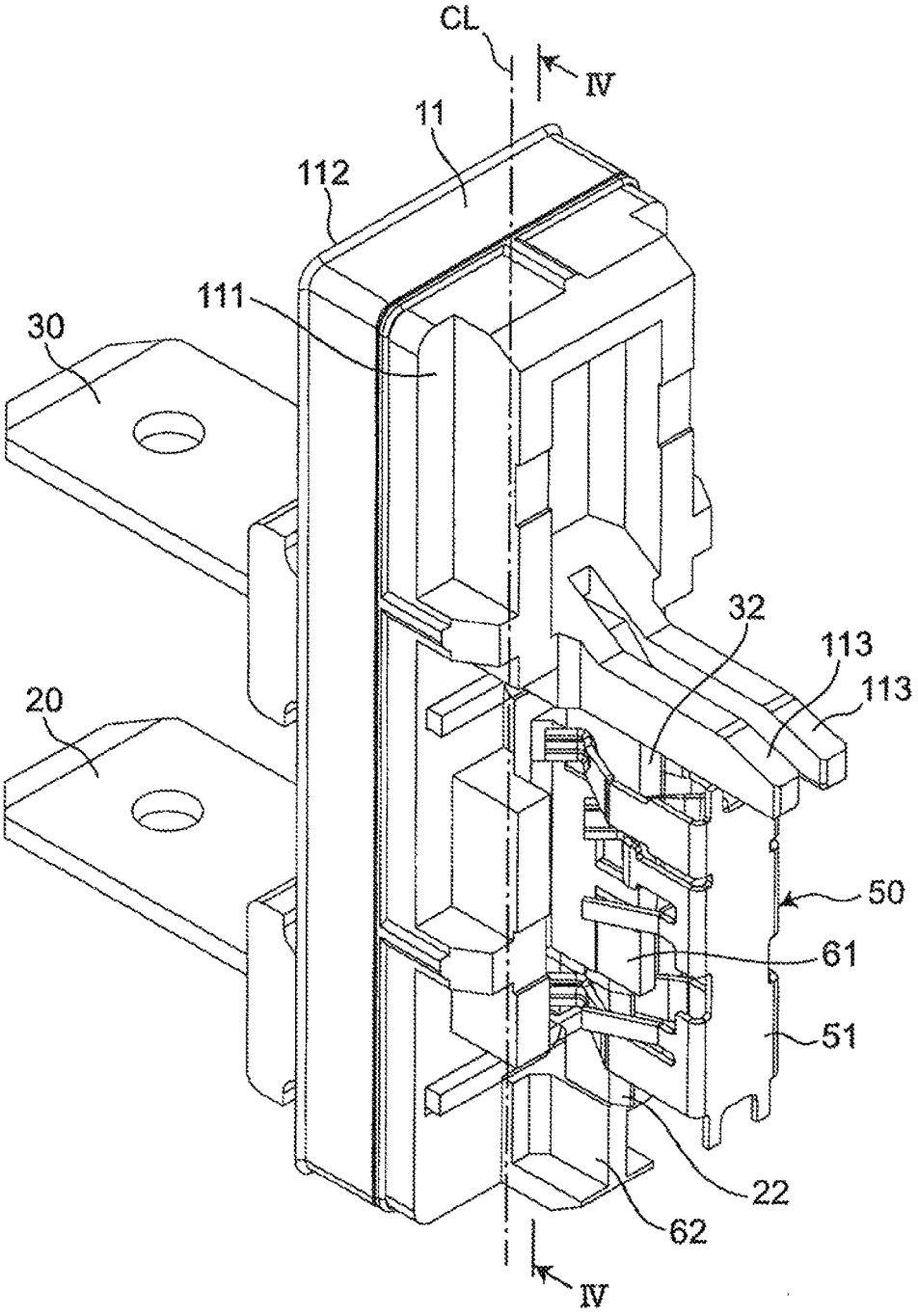
FIG. 3 is a perspective view illustrating an internal structure of a plunger included in a switch, such as in FIG. 1.

As shown in FIG. 3, the base 11 has a pair of protrusions 113, which protrudes from the first rectangular surface 111 in a direction intersecting with (or for example substantially perpendicular to) the first rectangular surface 111, and a first insulating wall 61 and a second insulating wall 62, which are spaced from each other on the first rectangular surface 111 in the longitudinal direction of the base 11.

The pair of protrusions 113 is arranged between an opening 15 in the cover 12 (described later) and a moving contact unit 50 included in the plunger 40 (described later), and supports a coil spring 43 included in the plunger 40 (described later). An individual stationary contact 32, which is included in the individual stationary contact terminal 30 (described later), is arranged between the two protrusions 113.

The first insulating wall 61 is an example of an individual-contact insulator. The first insulating wall 61 is arranged substantially in the middle of the lateral direction of the first rectangular surface 111 and between the common stationary contact terminal 20 and the individual stationary contact terminal 30. As shown in FIG. 4, the first insulating wall 61 includes, on each of its two sides in the thickness direction (or the lateral direction of the base 11), a first flat surface 63, a tapered surface 64, and a second flat surface 65 in this order in the longitudinal direction of the base 11 from the individual stationary contact terminal 30 toward the common stationary contact terminal 20. The first insulating wall 61 has a larger thickness at the first flat surface 63 than at the second flat surface 65. In the direction which the common stationary contact terminal 20 and the individual stationary contact terminal 30 are arranged in parallel (specifically, in the horizontal direction in FIG. 4), the tapered surfaces 64 on the two sides slope away from each other from the common stationary contact terminal 20 toward the individual stationary contact terminal 30.

As shown in FIG. 4, the tapered surface 64 and the second flat surface 65 are defined only at an upper end of the base 11 above the center of the first insulating wall 61 in a direction perpendicular to the first rectangular surface 111 (or at the end of the base 11 away from the first rectangular surface 111).

The second insulating wall 62 is an example of a common-contact insulator. The second insulating wall 62 is arranged substantially in the middle of the lateral direction of the first rectangular surface 111 with the common stationary contact terminal 20 between the second insulating wall 62 and the first insulating wall 61. The first insulating wall 61 and the second insulating wall 62 are integral with the base 11.

As shown in FIG. 1, the cover 12 includes the opening 15 in one of its sides (the upper surface in FIG. 1) intersecting with (or for example substantially perpendicular to) the first rectangular surface 111 of the base 11. The opening 15 receives a protrusion 42 of the plunger 40 (described later).

As shown in FIG. 4, the common stationary contact terminal 20 includes a plate-like terminal segment 21, which extends from outside the housing 10 to the compartment 13 of the housing 10, and a plate-like common stationary contact 22, which is arranged in the compartment 13. The terminal segment 21 has its plate surface extending in a direction intersecting with (or for example substantially perpendicular to) the longitudinal direction of the base 11. The common stationary contact 22 has its plate surface extending in the longitudinal direction of the base 11. In other words, the terminal segment 21 and the common stationary contact 22 have their plate surfaces intersecting with (or for example substantially perpendicular to) each other.

Figure 5:
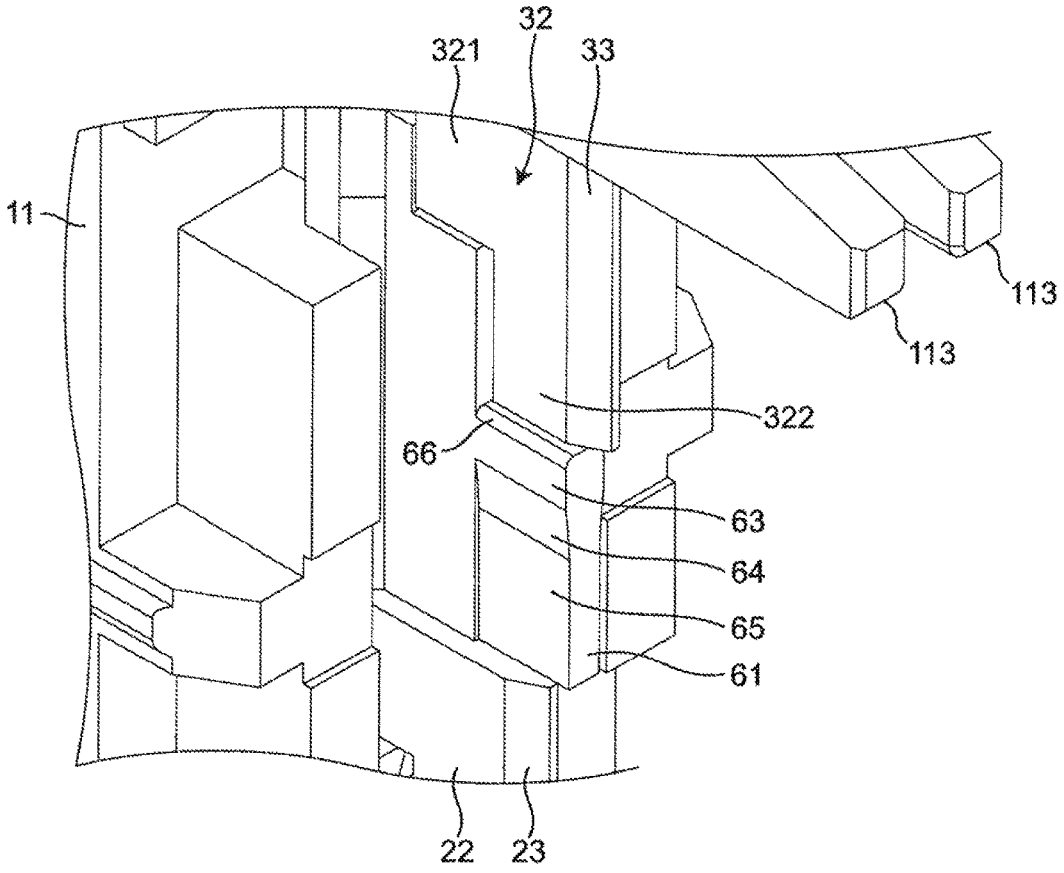
FIG. 5 is an enlarged perspective view of a switch, such as in FIG. 1, illustrating an area around an insulator.

As shown in FIG. 5, the common stationary contact 22 has a pair of slopes 23 (FIG. 5 shows one slope) on its upper end (specifically, an end away from the first rectangular surface 111 in the direction perpendicular to the first rectangular surface 111). The two slopes 23 slope away from each other from the upper end of the common stationary contact 22 toward the base 11. As viewed in the direction perpendicular to the first rectangular surface 111, the slopes 23 are symmetric to each other with respect to the lateral center line CL of the base 11 (shown in FIG. 3). The pair of slopes 23 facilitates insertion of the common stationary contact 22 between a pair of first arms 52 included in the moving contact unit 50 (described later).

As shown in FIG. 4, the individual stationary contact terminal 30 includes a plate-like terminal segment 31, which extends from outside the housing 10 to the compartment 13 of the housing 10, and the plate-like individual stationary contact 32, which is arranged in the compartment 13. The terminal segment 31 has its plate surface extending in a direction intersecting with (or for example substantially perpendicular to) the longitudinal direction of the base 11 and faces the plate surface of the terminal segment 21 of the common stationary contact terminal 20. The individual stationary contact 32 has its plate surface extending in the longitudinal direction of the base 11 and is substantially parallel to the plate surface of the common stationary contact 22 of the common stationary contact terminal 20. The terminal segment 31 and the individual stationary contact 32 have their plate surfaces intersecting with (or for example substantially perpendicular to) each other.

The individual stationary contact 32 includes a first individual stationary contact 321 and a second individual stationary contact 322. The first individual stationary contact 321 and the second individual stationary contact 322 are adjacent to and integral with each other in a direction perpendicular to the first rectangular surface 111 of the base 11, and together form a single plate. The first individual stationary contact 321 is located nearer the first rectangular surface 111 than the second individual stationary contact 322 in the direction perpendicular to the first rectangular surface 111. The second individual stationary contact 322 has a direct distance L2 from the protrusions 113 to an end adjacent to the common stationary contact 22 in the longitudinal direction of the base 11 greater than a direct distance L1 for the first individual stationary contact 321 from the protrusions 113 to an end adjacent to the common stationary contact 22 in the longitudinal direction of the base 11.

As shown in FIG. 5, the individual stationary contact 32 has a pair of slopes 33 (FIG. 5 shows one slope) on its upper end (specifically, an end of the second individual stationary contact 322 in the direction perpendicular to the first rectangular surface 111). The two slopes 33 slope away from each other from the upper end of the individual stationary contact 32 toward the base 11. The slopes 33 are symmetric to each other with respect to the lateral center line of the base 11. The pair of slopes 33 facilitates insertion of the individual stationary contact 32 between a pair of second arms 53 and a pair of third arms 54 included in the moving contact unit 50 (described later).

As shown in FIG. 4, a direct distance L3 from the first rectangular surface 111 of the base 11 to the upper end of the individual stationary contact 32 is greater than a direct distance L4 from the first rectangular surface 111 of the base 11 to the upper end of the common stationary contact 22.

As shown in FIGS. 3 and 4, the first insulating wall 61 and the second insulating wall 62, and the common stationary contact 22 and the individual stationary contact 32 are arranged along the lateral center line of the base 11 in a manner symmetric to each other with respect to the center line.

The plate surface of the individual stationary contact 32 extends substantially on the same plane as the first flat surface 63, which is one side of the first insulating wall 61 extending in the thickness direction and located in the same direction as the plate surface with respect to the lateral center line of the base 11. The plate surface of the common stationary contact 22 extends substantially on the same plane as the side of the second insulating wall 62 extending in the thickness direction and located in the same direction as the plate surface with respect to the lateral center line of the base 11.

As shown in FIG. 4, the individual stationary contact 32 and the first insulating wall 61 have a first gap 71 between them in the longitudinal direction of the base 11. The gap 71 has a substantially constant width that is narrower than a width W (refer to FIG. 6) of the third arms 54 at a third moving contact 541 (described later) in the lateral direction (or the direction in which the common stationary contact terminal 20 and the individual stationary contact terminal 30 are arranged parallel to each other).

The common stationary contact 22 has sides facing the first insulating wall 61 and the second insulating wall 62 that extend in a direction substantially perpendicular to the first rectangular surface 111 of the base 11. The individual stationary contact 32 has sides of the first individual stationary contact 321 and the second individual stationary contact 322 facing the first insulating wall 61 that also extend in the direction substantially perpendicular to the first rectangular surface 111 of the base 11.

As shown in FIG. 5, the first insulating wall 61 has chamfered, curved edges 66 (FIG. 5 shows one edge) on its surface facing the individual stationary contact 32 in the longitudinal direction of the base 11.

First to third moving contacts 521, 531, and 541 (described later) come in contact with or separate from the common stationary contact 22 or the individual stationary contact 32 to generate an arc with heat, which may melt the common stationary contact 22, the individual stationary contact 32, and the first to third moving contacts 521, 531, and 541. The conductive powder resulting from the molten contact under the arc heat can scatter inside the compartment 13, and may accumulate on, for example, the insulating wall 61 or 62. This can form a short-circuit on the surface of the insulating wall 61 or 62, thus lowering the insulation between the common stationary contact 22 and the individual stationary contact 32.

The switch 1 with the above structure has the substantially constant gap 71 between the individual stationary contact terminal 30 and the first insulating wall 61 in the longitudinal direction of the base 11, and further has a substantially constant gap 73 between the common stationary contact terminal 20 and the second insulating wall 62. The scattered powder resulting from an arc that occurs when each moving contact and the corresponding stationary contact come in contact with or separate from each other accumulates in the gaps 71 and 73. This reduces the powder to accumulate on the insulating walls 61 and 62, and thus prevents the insulation between the common stationary contact 22 and the individual stationary contact 32 from deteriorating.

As shown in FIG. 2, the plunger 40 extends in the longitudinal direction of the base 11, and is supported by the cover 12 of the housing 10 in a manner movable in the direction in which the common stationary contact terminal 20 and the individual stationary contact terminal 30 are arranged parallel to each other (the vertical direction in FIG. 2).

The plunger 40 includes a substantially rectangular box-like insulating case 41, and the substantially cylindrical protrusion 42 extending from one of the two sides of the case 41 facing in the longitudinal direction of the case 41.

The case 41 is arranged inside the compartment 13. The case 41 accommodates the coil spring 43 and the conductive moving contact unit 50 (shown in FIG. 3). The coil spring 43 and the moving contact unit 50 are separated by the pair of protrusions 113 on the base 11.

The case 41 has an opening 44 in a side opposite to the side facing the base 11. The coil spring 43 is exposed through the opening 44. The opening 44 extends from a substantially middle part of the case 41 toward the protrusion 42 in the longitudinal direction of the case 41. The tips of the protrusions 113 protrude through the opening 44 at the substantially middle end of the case 41. The case 41 also has positioning through-holes 45 for positioning the moving contact unit 50 on its side having the opening 44.

The protrusion 42 protrudes outside the housing 10 through the opening 15 in the cover 12 of the housing 10. This structure allows the plunger 40 to move in the vertical direction in FIG. 2 when the protrusion 42 receives an external force. The part of the protrusion 42 exposed outside the housing 10 includes an elastic annular stepped member 46, which fills the gap between the opening 15 and the protrusion 42.

The coil spring 43, which is supported by the pair of protrusions 113, urges the case 41 upward in FIG. 2 (specifically away from the pair of protrusions 113 in the longitudinal direction of the base 11).

Figure 6:
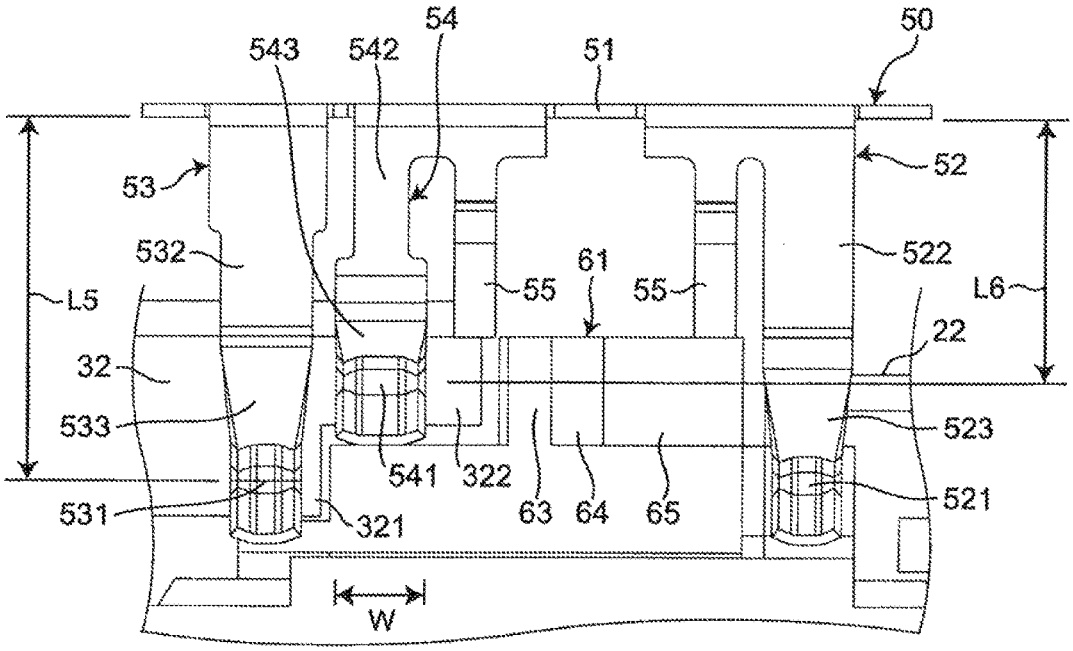
FIG. 6 is a side view illustrating a moving contact unit of a switch, such as in FIG. 1.

As shown in FIG. 6, the moving contact unit 50 includes a body 51, the first arms 52, the second arms 53, and the third arms 54, which are electrically interconnected with each other through the body 51.

As shown in FIG. 6, the body 51 is a rectangular plate extending in the direction in which the common stationary contact terminal 20 and the individual stationary contact terminal 30 are arranged parallel to each other (specifically, the longitudinal direction of the base 11). The body 51 has its plate surface extending substantially parallel to the first rectangular surface 111 on the base 11.

The first arms 52, the second arms 53, and the third arms 54 are each plate-like, and extend from the two lateral ends of the body 51 in a direction intersecting with the direction in which the common stationary contact terminal 20 and the individual stationary contact terminal 30 are arranged parallel to each other (specifically in the direction intersecting with or substantially perpendicular to the first rectangular surface 111 of the base 11) as shown in FIG. 6. The first arms 52, the second arms 53, and the third arms 54 are spaced apart from one another on the body 51 in the direction in which the common stationary contact terminal 20 and the individual stationary contact terminal 30 are arranged parallel to each other.

Figure 7:
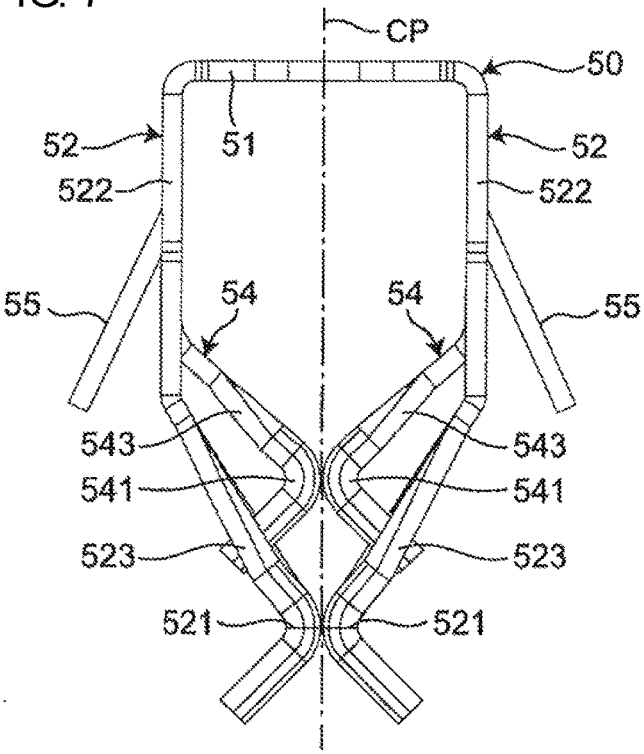
FIG. 7 is a front view illustrating a moving contact unit of a switch, such as in FIG. 1.

As shown in FIG. 7, the first arms 52, the second arms 53, and the third arms 54 are in pairs, and the arms in each pair are arranged symmetric to each other with respect to a perpendicular plane CP passing through the center of the plate surface of the body 51 and perpendicular to the plate surface of the body 51. As shown in FIG. 6, the first arms 52 and the second arms 53 are arranged at the two longitudinal ends of the body 51. The third arms 54 are located between the first arms 52 and the second arms 53 and nearer the second arms 53 than the longitudinal center of the body 51.

As shown in FIGS. 6 and 7, each of the first arms 52 includes a fixed portion 522, which is one end fixed to the body 51, and an elastic portion 523, which is elastically deformable relative to the fixed portion 522 in the thickness direction of the first arm 52 and away from the body 51. The elastic portion 523 includes the first moving contact 521. The pair of first arms 52 thus holds the common stationary contact 22 with its first moving contacts 521 in contact with the two plate surfaces of the common stationary contact 22. The first moving contacts 521 can thus come in slide contact with the plate surfaces of the common stationary contact 22 while maintaining contact as the plunger 40 moves in the direction in which the common stationary contact terminal 20 and the individual stationary contact terminal 30 are arranged parallel to each other (specifically, the longitudinal direction of the base 11).

As shown in FIG. 6, each of the second arms 53 includes a fixed portion 532, which is one end fixed to the body 51, and an elastic portion 533, which is elastically deformable relative to the fixed portion 532 in the thickness direction of the second arm 53 and away from the body 51. The elastic portion 533 includes the second moving contact 531. The pair of second arms 53 thus holds the first individual stationary contact 321 with its second moving contacts 531 in contact with the two plate surfaces of the first individual stationary contact 321. The second moving contacts 531 can thus come in slide contact with the plate surfaces of the first individual stationary contact 321 of the individual stationary contact 32 while maintaining contact as the plunger 40 moves in the longitudinal direction of the base 11.

As shown in FIGS. 6 and 7, each of the third arms 54 includes a fixed portion 542, which is one end fixed to the body 51, and an elastic portion 543, which is elastically deformable relative to the fixed portion 542 in the thickness direction of the third arm 54 and away from the body 51. The elastic portion 543 includes the third moving contact 541. The pair of third arms 54 thus holds the second individual stationary contact 322 with its third moving contacts 541 in contact with the two plate surfaces of the second individual stationary contact 322. The third moving contacts 541 can thus come in slide contact with the plate surfaces of the second individual stationary contact 322 of the individual stationary contact 32 while maintaining contact as the plunger 40 moves in the longitudinal direction of the base 11.

As shown in FIG. 6, the second arms 53 and the third arms 54 extend in the same direction from the body 51 with respect to the perpendicular plane CP.

Each second arm 53 has a direct distance L5 from the body 51 to the second moving contact 531 greater than a direct distance L6 from the body 51 to the third moving contact 541 of the third arm 54. This structure allows the moving contact unit 50 to come in contact with, at one time, the common stationary contact 22, the first individual stationary contact 321, and the second individual stationary contact 322 as the plunger 40 moves in the longitudinal direction of the base 11.

The body 51 includes plate-like positioning arms 55 between the first arms 52 and the third arms 54. The positioning arms 55 extend from the two lateral ends of the body 51 in a direction intersecting with the first rectangular surface 111 of the base 11. The positioning arms 55 can be placed in the positioning through-holes 45 in the case 41 for the plunger 40.

The operation of the switch 1 will now be described with reference to FIGS. 8 to 12. FIGS. 8 to 12 show the switch 1 in the state shown in FIG. 2 (with the cover 12 and the annular stepped member 46 of the housing 10 being removed), with the case 41 for the plunger 40 being transparent.

Figure 8:
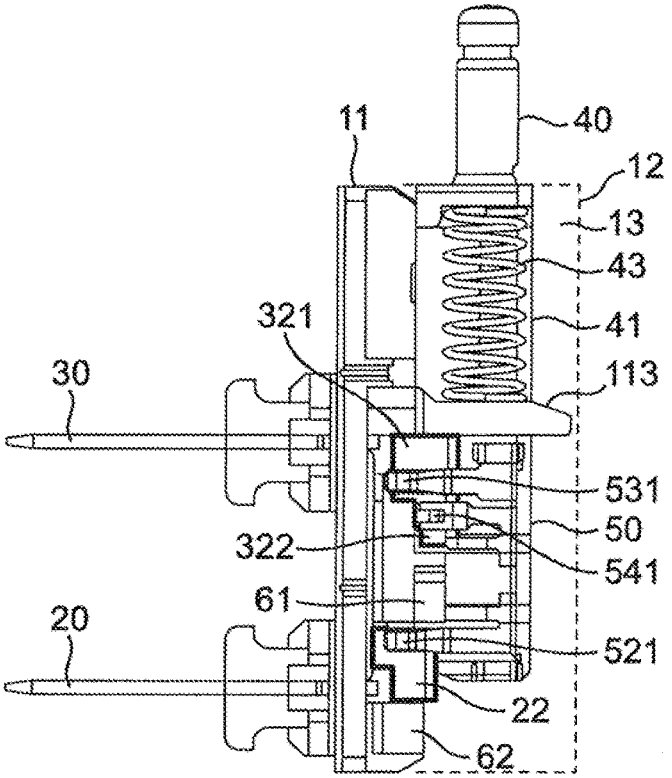
FIG. 8 is a diagram illustrating the operation of a switch, such as in FIG. 1.

As shown in FIG. 8, when the protrusion 42 of the plunger 40 receives no external force, the plunger 40 arranged in the compartment 13 is urged by the internal coil spring 43 upward in FIG. 8 with the upper end of the case 41 in contact with the cover 12 of the housing 10.

In this state, the moving contact unit 50 has its first moving contact 521 in contact with the common stationary contact 22, its second moving contact 531 in contact with the first individual stationary contact 321, and its third moving contact 541 in contact with the second individual stationary contact 322. Thus, the switch 1 is on.

Figure 9:
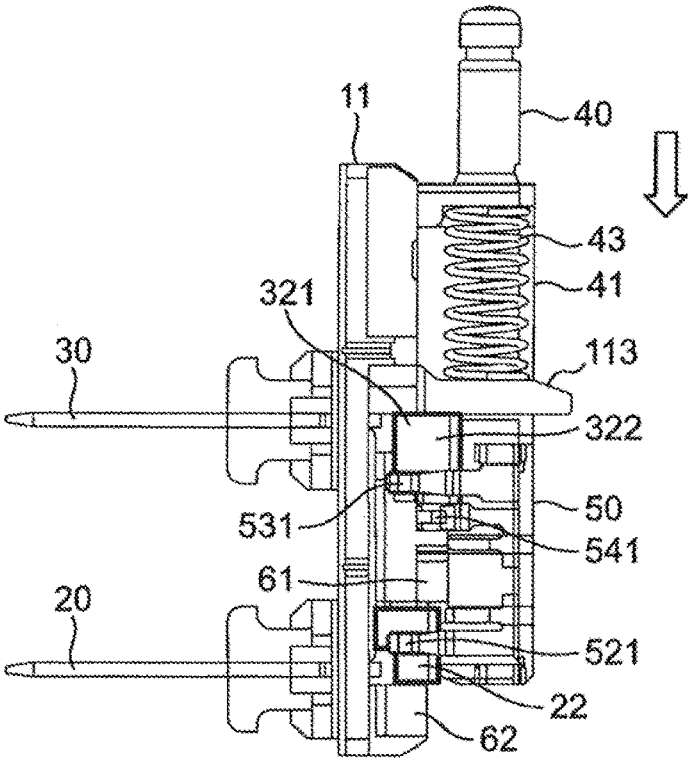
FIG. 9 is a diagram illustrating the operation of a switch, such as in FIG. 1, continuous from the operation, such as in FIG. 8.

As shown in FIG. 9, when the protrusion 42 of the plunger 40 receives an external force pressing the plunger 40 into the housing 10 against the urging force of the coil spring 43, the moving contact unit 50 moves from the individual stationary contact terminal 30 toward the common stationary contact terminal 20. This causes the second moving contact 531 to separate from the first individual stationary contact 321 and come in contact with the first insulating wall 61, with the first moving contact 521 in contact with the common stationary contact 22 and the third moving contact 541 in contact with the second individual stationary contact 322.

In this state, the first moving contact 521 remains in contact with the common stationary contact 22 and the third moving contact 541 remains in contact with the second individual stationary contact 322. Thus, the switch 1 is on.

Figure 10:
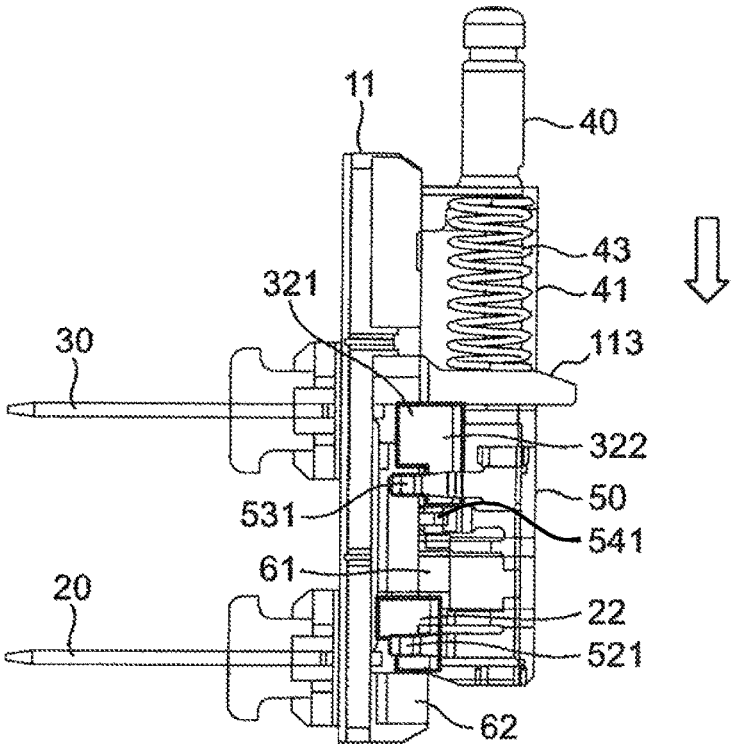
FIG. 10 is a diagram illustrating the operation of a switch, such as in FIG. 1, continuous from the operation, such as in FIG. 9.

As shown in FIG. 10, when the plunger 40 is pressed further into the housing 10, the moving contact unit 50 further moves from the individual stationary contact terminal 30 toward the common stationary contact terminal 20. This causes the third moving contact 541 to separate from the second individual stationary contact 322 and come in contact with the first insulating wall 61, with the first moving contact 521 in contact with the common stationary contact 22 and the second moving contact 531 in contact with the first insulating wall 61.

In this state, the switch 1, which has been on, is turned off although the first moving contact 521 remains in contact with the common stationary contact 22. As the switch 1, which has been on, is turned off, an arc occurs between the third moving contact 541 and the second individual stationary contact 322.

Figure 11:
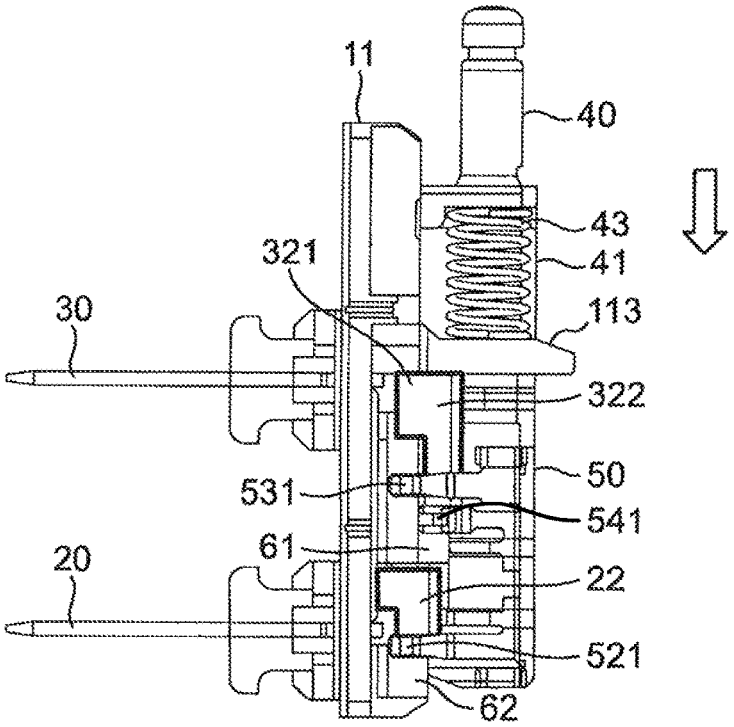
FIG. 11 is a diagram illustrating the operation of a switch, such as in FIG. 1, continuous from the operation, such as in FIG. 10.

As shown in FIG. 11, when the plunger 40 is pressed further into the housing 10, the moving contact unit 50 moves from the individual stationary contact terminal 30 toward the common stationary contact terminal 20. This causes the first moving contact 521 to separate from the common stationary contact 22 and come in contact with the second insulating wall 62, with the second moving contact 531 and the third moving contact 541 in contact with the first insulating wall 61.

In this state, the second moving contact 531 slides on the first flat surfaces 63 of the first insulating wall 61 as the plunger 40 moves, whereas the third moving contact 541 slides on the first flat surfaces 63, the tapered surfaces 64, and the second flat surfaces 65 sequentially in this order. More specifically, the tapered surfaces 64 slopes toward the third moving contact 541 at smaller distances to the individual stationary contact terminal 30 in the direction in which the common stationary contact terminal 20 and the individual stationary contact terminal 30 are arranged parallel to each other.

Figure 12:
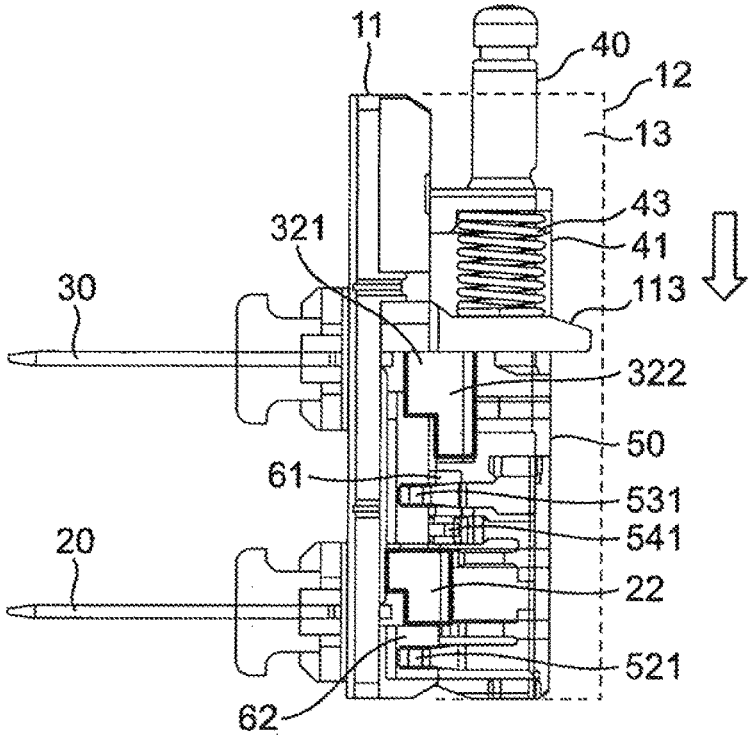
FIG. 12 is a diagram illustrating the operation of a switch, such as in FIG. 1, continuous from the operation, such as in FIG. 11.

As shown in FIG. 12, the bottom end of the case 41 comes in contact with the cover 12 of the housing 10. This stops the plunger 40 while the switch 1 remains off.

After the plunger 40 stops, releasing the external force applied to the protrusion 42 of the plunger 40 causes the moving contact unit 50 to move from the common stationary contact terminal 20 toward the individual stationary contact terminal 30 under the urging force of the coil spring 43. This causes the first moving contact 521 to separate from the second insulating wall 62 and come in contact with the common stationary contact 22, and then the third moving contact 541 to separate from the first insulating wall 61 and come in contact with the second individual stationary contact 322. Subsequently, the second moving contact 531 is to separate from the first insulating wall 61 and come in contact with the first individual stationary contact 321, returning to the state shown in FIG. 8.

In the switch 1 described above, the plunger 40 moves from the individual stationary contact terminal 30 toward the common stationary contact terminal 20 in the direction in which the common stationary contact terminal 20 and the individual stationary contact terminal 30 are arranged parallel to each other, with the first moving contact 521 in contact with the common stationary contact 22, the second moving contact 531 in contact with the first individual stationary contact 321, and the third moving contact 541 in contact with the second individual stationary contact 322. This causes the second moving contact 531 to separate from the first individual stationary contact 321 and then causes the third moving contact 541 to separate from the second individual stationary contact 322. The switch 1 includes the common stationary contact terminal 20, the individual stationary contact terminal 30, and the moving contact unit 50 that operate in the manner described above.

In other words, the moving contact unit 50 includes the first moving contact 521 in contact with the common stationary contact 22, the second moving contact 531 in contact with the first individual stationary contact 321, and the third moving contact 541 in contact with the second individual stationary contact 322. This is referred to as a first contact state (refer to FIG. 8). In a second contact state (refer to FIG. 9), the first moving contact 521 remains in contact with the common stationary contact 22 and the third moving contact 541 remains in contact with the second individual stationary contact 322, while the second moving contact 531 is in contact with the first insulating wall 61. In a third contact state (refer to FIG. 10), the first moving contact 521 remains in contact with the common stationary contact 22, and the second moving contact 531 and the third moving contact 541 are both in contact with the first insulating wall 61. When the switch 1, which has been on, is turned off, the state of the common stationary contact terminal 20, the individual stationary contact terminal 30, and the moving contact unit 50 changes from the first contact state to the third contact state via the second contact state as the plunger 40 moves. When the switch 1, which has been off, is turned on, the state changes from the third contact state to the first contact state via the second contact state.

In the above switch 1, the first arms 52, the second arms 53, and the third arms 54 in the moving contact unit 50 extend in the direction intersecting with the movement direction of the plunger 40. The arms of the moving contact unit 50 are less susceptible to damage from an arc that may occur when each moving contact comes in contact with or separates from the corresponding stationary contact, and allows the switch 1 to have larger capacity.

The moving contact unit 50 includes the second arms 53 and the third arms 54 extending in the same direction from the body 51. The direct distance L5 from the body 51 to the second moving contact 531 is greater than the direct distance L6 from the body 51 to the third moving contact 541. As described above, the direct distance L6 from the body 51 to the third moving contact 541 less than the direct distance L5 from the body 51 to the second moving contact 531 causes the third moving contact 541 to have a higher contact pressure against the second individual stationary contact 322, and thus reduces a contact bounce that occurs when the third moving contact 541 comes in contact with or separates from the second individual stationary contact 322. This structure further maintains the first individual stationary contact 321 away from an arc that occurs when the third moving contact 541 comes in contact with or separates from the second individual stationary contact 322, and thus reduces deterioration in the insulation of the first individual stationary contact 321. The arms of the moving contact unit 50 are less susceptible to an arc. The switch 1 can have higher capacity.

The moving contact unit 50 includes the plate-like body 51, the pair of first arms 52, the pair of second arms 53, and the pair of third arms 54. The arms in each pair are arranged symmetric to each other with respect to the perpendicular plane CP passing through the center line of the plate surface of the body 51 and perpendicular to the plate surface of the body 51. This structure allows the first moving contact 521 to hold the common stationary contact 22, the second moving contact 531 to hold the first individual stationary contact 321, and the second individual stationary contact 322 to hold the third moving contact 541, thus increasing the contact reliability of the switch 1.

In the direction in which the common stationary contact terminal 20 and the individual stationary contact terminal 30 are arranged parallel to each other, the first insulating wall 61 includes the tapered surfaces 64, which slope toward the third moving contact 541 at smaller distances to the individual stationary contact terminal 30, and face and come in contact with the third moving contact 541 as the plunger 40 moves. This structure reduces the contact pressure of the third moving contact 541 against the first insulating wall 61 as the plunger 40 moves, and thus extends the lifetime of the first insulating wall 61 and the lifetime of the switch 1. The switch 1 can have higher capacity.

The second individual stationary contact 322 and the first insulating wall 61 have the gap 71 between them. The gap 71 is narrower than the width W of the third arms 54 at the third moving contact 541 in the direction in which the common stationary contact terminal 20 and the individual stationary contact terminal 30 are arranged parallel to each other. The gap 71 enables the first insulating wall 61 less susceptible to an arc that may occur when the third moving contact 541 comes in contact with or separates from the second individual stationary contact 322, and thus extends the lifetime of the first insulating wall 61 and the lifetime of the switch 1. The switch 1 can have higher capacity.

The switch 1 further includes the second insulating wall 62, which is adjacent to the common stationary contact 22 located farther from the individual stationary contact terminal 30 in the direction in which the common stationary contact terminal 20 and the individual stationary contact terminal 30 are arranged parallel to each other. The second insulating wall 62 faces and comes in contact with the first moving contact 521 of the moving contact unit 50 as the plunger 40 moves. The switch 1 with this structure is turned off in a more reliable manner.

The moving contact unit 50 includes the first arms 52, the second arms 53, and the third arms 54 extending from the body 51 in the direction perpendicular to the direction in which the common stationary contact terminal 20 and the individual stationary contact terminal 30 are arranged parallel to each other. This structure maintains the first individual stationary contact 321 in a more reliable manner away from an arc that may occur when the third moving contact 541 comes in contact with or separates from the second individual stationary contact 322, and thus reduces deterioration in the insulation of the first individual stationary contact 321 in a more reliable manner. The arms of the moving contact unit 50 are less susceptible to an arc. The switch 1 can have higher capacity.

The first arms 52, the second arms 53, and the third arms 54 of the moving contact unit 50 are plate-like. Each moving contact is elastically deformable in the thickness direction away from the body 51, and comes in slide contact with the corresponding stationary contact as the plunger 40 moves. This structure allows each moving contact to have a higher contact pressure against the corresponding stationary contact, thus increasing the contact reliability of the switch 1.

Figure 13:
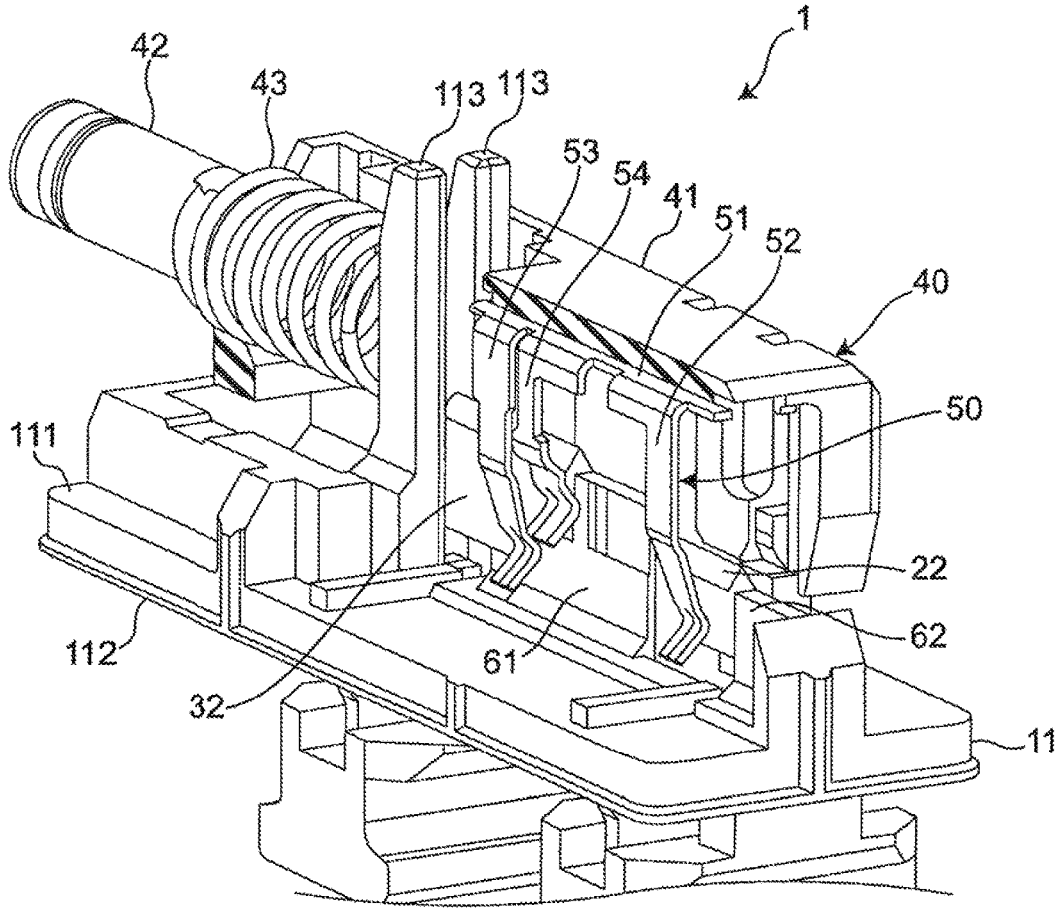
FIG. 13 is a perspective view illustrating a switch according to a modification of a switch, such as in FIG. 1.

The switch 1 includes the moving contact unit having the first arms, the second arms, and the third arms extending in the direction intersecting with the movement direction of the plunger, and may have the structure other than described in one or more embodiments. For example, the direct distance from the body of the moving contact unit 50 to the second moving contact may be the same as the direct distance from the body to the third moving contact. As shown in FIG. 13, the moving contact unit 50 may not include each pair of first, second and third arms, but may include a single first arm, a single second arm, and/or a single third arm. FIG. 13 shows one of two halves of the case 41 for the plunger 40 divided in the lateral direction of the base 11 using a hatched cross-section.

The individual-contact insulator and the common-contact insulator may not be the first insulating wall 61 and the second insulating wall 62, and may each be an insulating space.

The gap 71 between the individual stationary contact terminal 30 and the first insulating wall 61, and the tapered surfaces 64 on the first insulating wall 61 may be eliminated.

The moving contact unit 50 including the moving contacts can come in contact with their corresponding stationary contacts at one time. The moving contact unit 50 may have the arms with any structures in accordance with the design of the switch 1.

Although the switch 1 according to one or more embodiments is a normally closed switch (b-contact) that is turned on under no external force applied to the protrusion 42, the switch 1 may be a normally open switch (a-contact) that is turned off under an external force applied to the protrusion 42 of the plunger 40.

One or more embodiments are described in detail with reference to the drawings. One or more embodiments may be modified in various forms described below.

A switch according to one aspect includes a housing, a common stationary contact terminal, an individual stationary contact terminal, and a plunger. The housing includes an internal compartment. The common stationary contact terminal extends from outside the housing to the compartment and is fixed to the housing, and includes a common stationary contact arranged in the compartment. The individual stationary contact terminal extends from outside the housing to the compartment and is arranged parallel to the common stationary contact terminal, and includes a first individual stationary contact and a second individual stationary contact that are fixed to the housing and arranged in the compartment and electrically independent of the common stationary contact terminal. The plunger is supported by the housing in a manner movable in a parallel direction in which the common stationary contact terminal and the individual stationary contact terminal are arranged parallel to each other. The plunger includes a moving contact unit arranged in the compartment in a manner to come in contact with, at one time, the common stationary contact, the first individual stationary contact, and the second individual stationary contact as the plunger moves in the parallel direction. The moving contact unit includes a body extending in the parallel direction, a first arm, a second arm, and a third arm extending from the body in a direction intersecting with the parallel direction and electrically interconnected and spaced from one another in the parallel direction, a first moving contact included in the first arm to come in contact with the common stationary contact, a second moving contact included in the second arm to come in contact with the first individual stationary contact, and a third moving contact included in the third arm to come in contact with the second individual stationary contact. The common stationary contact terminal, the individual stationary contact terminal, and the moving contact unit are configured to cause the second moving contact to separate from the first individual stationary contact and then the third moving contact to separate from the second individual stationary contact when the plunger moves in the parallel direction while the first moving contact is in contact with the common stationary contact, the second moving contact is in contact with the first individual stationary contact, and the third moving contact is in contact with the second individual stationary contact.

The switch according to a first aspect includes the first arm, the second arm, and the third arm in the moving contact unit each extending in a direction intersecting with the movement direction of the plunger. The arms of the moving contact unit are less susceptible to an arc that may occur when each moving contact comes in contact with or separates from the corresponding stationary contact as the plunger moves. The switch can have higher capacity.

In the switch according to a second aspect, the second arm and the third arm extend from the body in the same direction, and a direct distance from the body to the second moving contact is greater than a direct distance from the body to the third moving contact.

In the switch according to a second aspect, the direct distance from the body to the third moving contact less than the direct distance from the body to the second moving contact causes the third moving contact to have a higher contact pressure against the second individual stationary contact, and thus reduces a contact bounce that occurs when the third moving contact comes in contact with or separates from the second individual stationary contact. This structure further maintains the first individual stationary contact away from an arc that occurs when the third moving contact comes in contact with or separates from the second individual stationary contact, and thus reduces deterioration in the insulation of the first individual stationary contact. The arms of the moving contact unit are less susceptible to an arc. The switch can have higher capacity.

In the switch according to a third aspect, the body is plate-like, and the moving contact unit includes a pair of the first arms, a pair of the second arms, and a pair of the third arms, and the arms in each pair are arranged symmetric to each other with respect to a perpendicular plane passing through a center line of a plate surface of the body and perpendicular to the plate surface of the body.

The switch according to a third aspect includes the first moving contact, the second moving contact, and the third moving contact holding the common stationary contact, the first individual stationary contact, and the second individual stationary contact, and thus can have higher contact reliability.

The switch according to a fourth aspect further includes an individual-contact insulator adjacent to the second individual stationary contact located nearer the common stationary contact terminal in the parallel direction. The individual-contact insulator includes a tapered surface that slopes toward the third moving contact at smaller distances to the individual stationary contact terminal in the parallel direction, and that faces and comes in contact with the third moving contact as the plunger moves.

The switch according to a fourth aspect reduces the contact pressure of the third moving contact against the individual-contact insulator as the plunger moves, and thus extends the lifetime of the individual-contact insulator and the lifetime of the switch. The switch can have higher capacity.

In the switch according to a fifth aspect, the second individual stationary contact and the individual-contact insulator have a gap therebetween that is narrower than a width of the third arm at the third moving contact in the parallel direction.

In the switch according to a fifth aspect, the individual-contact insulator is less susceptible to an arc that may occur when the third moving contact comes in contact with or separates from the second individual stationary contact. This structure can thus extend the lifetime of the individual-contact insulator and the lifetime of the switch. The switch can have higher capacity.

The switch according to a sixth aspect further includes a common-contact insulator adjacent to the common stationary contact located farther from the individual stationary contact terminal in the parallel direction, and faces and comes in contact with the first moving contact of the moving contact unit as the plunger moves.

The switch according to a sixth aspect is turned off in a more reliable manner.

In the switch according to a seventh aspect, the first arm, the second arm, and the third arm extend from the body in a direction perpendicular to the parallel direction.

The switch according to a seventh aspect maintains the first individual contact in a more reliable manner away from an arc that may occur when the third moving contact comes in contact with or separates from the second individual stationary contact, and thus reduces deterioration in the insulation of the first individual stationary contact 321 in a more reliable manner. The arms of the moving contact unit are less susceptible to an arc. The switch can have higher capacity.

In the switch according to an eighth aspect, the first arm, the second arm, and the third arm are plate-like, the first moving contact is elastically deformable in a thickness direction of the first arm and away from the body, and comes in slide contact with the common stationary contact as the plunger moves in the parallel direction, the second moving contact is elastically deformable in a thickness direction of the second arm and away from the body, and comes in slide contact with the first individual stationary contact as the plunger moves in the parallel direction, and the third moving contact is elastically deformable in a thickness direction of the third arm and away from the body, and comes in slide contact with the second individual stationary contact as the plunger moves in the parallel direction.

The switch according to an eighth aspect allows each moving contact to have a higher contact pressure against the corresponding stationary contacts, and thus can have higher contact reliability.

The embodiments or modifications described above may be combined with one another to produce their advantageous effects. One or more embodiments may be combined with other embodiments, one or more modifications may be combined with other modifications, or one or more embodiments may be combined with one or more modifications.

The features of different embodiments or different modifications may also be combined.

INDUSTRIAL APPLICABILITY

The switch according to one or more embodiments may be used in, for example, light-emitting diode (LED) brake lamps for motorcycles.

REFERENCE SIGNS LIST

1 switch
10 housing
11 base
111 first rectangular surface
112 second rectangular surface
113 protrusion
12 cover
13 compartment
14 terminal slot
15 opening
20 common stationary contact terminal
21 terminal segment
22 common stationary contact
23 slope
30 individual stationary contact terminal
31 terminal segment
32 individual stationary contact
321 first individual stationary contact
322 second individual stationary contact
33 slope
40 plunger
41 case
42 protrusion
43 coil spring
44 opening
45 through-hole
46 annular stepped member
50 moving contact unit
51 body
52 first arm
521 first moving contact
522 fixed portion
523 elastic portion
53 second arm
531 second moving contact
532 fixed portion
533 elastic portion
54 third arm
541 third moving contact
542 fixed portion
543 elastic portion
55 positioning arm
61 first insulating wall
62 second insulating wall
63 first flat surface
64 tapered surface
65 second flat surface
66 edge
71, 72, 73 gap
L1 to L6 direct distance
CL center line
CP perpendicular plane
W width

The invention claimed is:

1. A switch, comprising:

a housing comprising an internal compartment;

a common stationary contact terminal extending from outside the housing to the compartment and fixed to the housing, the common stationary contact terminal comprising a common stationary contact arranged in the compartment;

an individual stationary contact terminal extending from outside the housing to the compartment and arranged parallel to the common stationary contact terminal, the individual stationary contact terminal comprising a first individual stationary contact and a second individual stationary contact that are fixed to the housing and arranged in the compartment, the first individual stationary contact and the second individual stationary contact being electrically independent of the common stationary contact terminal; and a plunger supported by the housing in a manner movable in a parallel direction in which the common stationary contact terminal and the individual stationary contact terminal are arranged parallel to each other, the plunger comprising a moving contact unit arranged in the compartment so as to come in contact with, at one time, the common stationary contact, the first individual stationary contact, and the second individual stationary contact as the plunger moves in the parallel direction, the moving contact unit comprising:

a body extending in the parallel direction;

a first arm, a second arm, and a third arm extending from the body in a direction intersecting with the parallel direction, the first arm, the second arm, and the third arm being electrically interconnected and spaced from one another in the parallel direction;

a first moving contact included in the first arm, the first moving contact configured to come into contact with the common stationary contact;

a second moving contact included in the second arm, the second moving contact configured to come into contact with the first individual stationary contact; and a third moving contact included in the third arm, the third moving contact configured to come into contact with the second individual stationary contact, wherein the common stationary contact terminal, the individual stationary contact terminal, and the moving contact unit cause the second moving contact to separate from the first individual stationary contact and then the third moving contact to separate from the second individual stationary contact in response to the plunger moving in the parallel direction while the first moving contact is in contact with the common stationary contact, the second moving contact is in contact with the first individual stationary contact, and the third moving contact is in contact with the second individual stationary contact.

2. The switch according to claim 1, wherein the second arm and the third arm extend from the body in a same direction, and a direct distance from the body to the second moving contact is greater than a direct distance from the body to the third moving contact.

3. The switch according to claim 1, wherein the body is plate-like, and the moving contact unit further comprises a pair of the first arms, a pair of the second arms, and a pair of the third arms, and the arms in each pair are arranged symmetric to each other with respect to a perpendicular plane passing through a center line of a plate surface of the body and perpendicular to the plate surface of the body.

4. The switch according to claim 1, further comprising:

an individual-contact insulator adjacent to the second individual stationary contact located nearer the common stationary contact terminal in the parallel direction, wherein the individual-contact insulator comprises a tapered surface that slopes toward the third moving contact at smaller distances to the individual stationary contact terminal in the parallel direction, and that faces and comes into contact with the third moving contact as the plunger moves.

5. The switch according to claim 4, wherein the second individual stationary contact and the individual-contact insulator have a gap therebetween that is narrower than a width of the third arm at the third moving contact in the parallel direction.

6. The switch according to claim 1, further comprising:

a common-contact insulator adjacent to the common stationary contact located farther from the individual stationary contact terminal in the parallel direction, and facing and coming into contact with the first moving contact of the moving contact unit as the plunger moves.

7. The switch according to claim 1, wherein the first arm, the second arm, and the third arm extend from the body in a direction perpendicular to the parallel direction.

8. The switch according to claim 1, wherein the first arm, the second arm, and the third arm are plate-like, the first moving contact is elastically deformable in a thickness direction of the first arm and away from the body, and comes in slide contact with the common stationary contact as the plunger moves in the parallel direction, the second moving contact is elastically deformable in a thickness direction of the second arm and away from the body, and comes in slide contact with the first individual stationary contact as the plunger moves in the parallel direction, and the third moving contact is elastically deformable in a thickness direction of the third arm and away from the body, and comes in slide contact with the second individual stationary contact as the plunger moves in the parallel direction.

9. The switch according to claim 2, wherein the body is plate-like, and the moving contact unit comprises a pair of the first arms, a pair of the second arms, and a pair of the third arms, and the arms in each pair are arranged symmetric to each other with respect to a perpendicular plane passing through a center line of a plate surface of the body and perpendicular to the plate surface of the body.

10. The switch according to claim 2, further comprising:

an individual-contact insulator adjacent to the second individual stationary contact located nearer the common stationary contact terminal in the parallel direction, wherein the individual-contact insulator comprises a tapered surface that slopes toward the third moving contact at smaller distances to the individual stationary contact terminal in the parallel direction, and that faces and comes into in contact with the third moving contact as the plunger moves.

11. The switch according to claim 3, further comprising:

an individual-contact insulator adjacent to the second individual stationary contact located nearer the common stationary contact terminal in the parallel direction, wherein the individual-contact insulator comprises a tapered surface that slopes toward the third moving contact at smaller distances to the individual stationary contact terminal in the parallel direction, and that faces and comes into contact with the third moving contact as the plunger moves.

12. The switch according to claim 9, further comprising:

an individual-contact insulator adjacent to the second individual stationary contact located nearer the common stationary contact terminal in the parallel direction, wherein the individual-contact insulator comprises a tapered surface that slopes toward the third moving contact at smaller distances to the individual stationary contact terminal in the parallel direction, and that faces and comes into contact with the third moving contact as the plunger moves.

* * * * *